US011500304B2

(12) United States Patent
Yi et al.

(10) Patent No.: US 11,500,304 B2
(45) Date of Patent: Nov. 15, 2022

(54) DEVELOPER SUPPLY CONTAINER AND ELECTROPHOTOGRAPHY IMAGING APPARATUS

(71) Applicant: PRINT-RITE • UNICORN IMAGE PRODUCTS CO., LTD. OF ZHUHAI, Guangdong (CN)

(72) Inventors: Xinhua Yi, Guangdong (CN); Xiaofeng Yang, Guangdong (CN)

(73) Assignee: PRINT-RITE • UNICORN IMAGE PRODUCTS CO., LTD. OF ZHUHAI

( * ) Notice: Subject to any disclaimer, the term of this patent is extended or adjusted under 35 U.S.C. 154(b) by 1 day.

(21) Appl. No.: 17/475,936

(22) Filed: Sep. 15, 2021

(65) Prior Publication Data

US 2022/0004120 A1 Jan. 6, 2022

Related U.S. Application Data

(63) Continuation of application No. PCT/CN2020/075616, filed on Feb. 18, 2020, and a (Continued)

(30) Foreign Application Priority Data

Mar. 20, 2019 (CN) ..... 201910210734.5
Mar. 20, 2019 (CN) ..... 201910210735.X

(51) Int. Cl.
*G03G 15/10* (2006.01)
*G03G 15/08* (2006.01)

(52) U.S. Cl.
CPC ..... *G03G 15/0872* (2013.01); *G03G 15/0808* (2013.01); *G03G 15/0812* (2013.01); *G03G 15/0889* (2013.01)

(58) Field of Classification Search
CPC ..... G03G 15/0808; G03G 15/0812; G03G 15/0872; G03G 15/0877; G03G 15/0886; G03G 15/0891
See application file for complete search history.

(56) References Cited

U.S. PATENT DOCUMENTS 10,191,413 B1 1/2019 Chuang et al.
2008/0199222 A1 8/2008 Nakajima
(Continued)

FOREIGN PATENT DOCUMENTS

CN 201000539 Y 1/2008
CN 201156162 Y 11/2008
(Continued)

OTHER PUBLICATIONS

International Search Report for PCT/CN2020/075567 dated Apr. 27, 2020; 2 pages.
(Continued)

*Primary Examiner* — Hoang X Ngo
(74) *Attorney, Agent, or Firm* — Lerner, David, Littenberg, Krumholz & Mentlik, LLP

(57) ABSTRACT

A developer supply container and an electrophotography imaging apparatus using the developer supply container, relating to the field of electronic imaging apparatuses. The developer supply container comprising an accommodating cylinder and a feeding member is provided in the accommodating cylinder, wherein an outer surface of the accommodating cylinder is provided with a driving receiving portion. The developer supply container is further provided with a housing located at an end of the accommodating cylinder, the housing is provided with a powder outlet. A first storage portion is provided at an end of the feeding member close to the housing, a second storage portion in communication with the first storage portion is provided in the housing, the second storage portion is in communication
(Continued)

with the powder outlet, and the second storage portion is provided with a stirring device therein.

20 Claims, 8 Drawing Sheets

Related U.S. Application Data continuation of application No. PCT/CN2020/075567, filed on Feb. 17, 2020.

(56) References Cited

U.S. PATENT DOCUMENTS

2015/0338775 A1* 11/2015 Hosokawa ..... G03G 15/0886 399/258
2016/0070204 A1* 3/2016 Suzuki ..... G03G 15/0886 399/258
2016/0091827 A1* 3/2016 Oba ..... G03G 15/0886 399/262
2021/0055673 A1 2/2021 Chen et al.

FOREIGN PATENT DOCUMENTS

| | | | |
|---|---|---|---|
| CN | 202257038 | U | 5/2012 |
| CN | 106873330 | A | 6/2017 |
| CN | 108089418 | A | 5/2018 |
| CN | 108681221 | A | 10/2018 |
| CN | 108762025 | A | 11/2018 |
| CN | 109725517 | A | 5/2019 |
| CN | 109725518 | A | 5/2019 |
| CN | 209570803 | U | 11/2019 |
| CN | 209570804 | U | 11/2019 |

OTHER PUBLICATIONS

International Search Report for PCT/CN2020/075616 dated May 20, 2020; 3 pages.

* cited by examiner

DEVELOPER SUPPLY CONTAINER AND ELECTROPHOTOGRAPHY IMAGING APPARATUS

CROSS REFERENCE TO RELATED APPLICATIONS

The present application is a continuation of International Application Nos. PCT/CN2020/075567, filed on Feb. 17, 2020, which claims priority from Chinese Patent Application No. CN201910210734.5 filed on Mar. 20, 2019, and PCT/CN2020/075616, filed on Feb. 18, 2020, which claims priority from Chinese Patent Application No. CN201910210735.X filed on Mar. 20, 2019 all of which are hereby incorporated herein by reference.

FIELD OF THE INVENTION

The present invention relates to the electronic imaging equipment field, specifically, relates to a new type of developer supply container and electronic imaging equipment uses this kind of developer supply container.

BACKGROUND

An electrophotography imaging apparatus usually comprises an image processing unit and a developer supply container which detachably arranged in the image processing unit. The developer supply container contains developer (toners) such as toner, which develops the electrostatic latent image formed on the image processing unit to form a visible image on media such as paper. As the developer is consumable, it needs to be constantly replenished into the electrophotography imaging apparatus, but the developer unit which detachably installs into the electrophotography imaging equipment usually only contains a certain amount of developer, therefore, the developer supply container needs to be replaced frequently.

FIG. 1 and FIG. 2 are respectively an exploded view and a sectional view of an existing developer supply container which detachably arranged in the image processing unit, the developer supply container 100 contains an accommodating portion for accommodating developer, further contains a feeding portion 120, the feeding portion 120 is used to feed developer in accommodating portion 120 with its own rotation, the developer supply container 100 further comprising a discharge portion 130, which comprises a discharge outlet 131 for allowing the developer accommodated by the accommodating portion 120 to be discharged, and the developer supply container 100 further comprising a pump portion 140, the pump portion 140 acts on the discharge portion 130 and comprising a volume that changes with repeated movement, and the developer supply container 100 further comprise a drive receiving portion 111, which is for receiving a rotational force from the developer replenishing device to rotate the accommodating portion 110, the developer supply container further comprises a drive converting portion 150, which is used to converting the rotational force received by the drive receiving portion 111 into a force to operate the pump portion 140.

In particular, the pump portion 140 is retractable and this retraction is sufficient to change the internal pressure of the developer supply container 100 by changing the volume. The drive converting portion 150 drives the pump portion 140 to perform axial expansion movement, which drives the internal air pressure of the developer supply container 100 to change between positive and negative pressure repeatedly.

Under the action of the positive pressure of the pump portion 140, the developer flows out of the discharge outlet 131 and enters the developer unit. When the pump portion 140 returns to its original state, the negative pressure drives the developer inside the developer supply container 100, to keep the internal developer maintain a fluffy state, preventing the developer from forming a mass that is not easy to discharge from the discharge outlet 131.

However, the pump portion 140 has a volume that changes with repeated movements to change the internal pressure of the developer supply container 100, and during the return of the pump portion 140 to its original state, there is a negative pressure that draws the developer back, causing the developer to be not supplied smoothly.

Thus, some existing developer supply containers are equipped with a blast cavity, a wind wheel is set in the blast cavity, and the wind wheel is equipped with multiple blades, when the developer supply component rotates, the wind wheel also rotates, and through the rotation of the wind wheel, airflow is further formed, and the airflow drives the developer flow which keeps the developer in a fluffy state. And some other developer supply containers are equipped with a discharge cavity at the upstream end of the powder outlet, spiral-shaped transmission components are installed in the discharge outlet, through the transmission components, the developer is stirred to keep the developer maintain a fluffy state. As both of the above two solutions do not require a pump portion, so the problem of the developer to be not supplied smoothly can be prevented and can keep the developer maintain a fluffy state.

However, since the above-mentioned solutions do not require a pump portion, the transfer volume of the developer is affected resulting in a small transfer volume reduction after each rotation of the developer feeding component, which affects the quality of the developed image and leads to the lighter color of the text, patterns formed on the paper.

DISCLOSURE OF INVENTION

Accordingly, the first object of the present invention is to provide a developer supply container that ensures that the developer are transferred to the powder outlet in a fluffy state.

The second object of the present invention is to provide a developer supply container that improves the transfer volume of the developer.

The third object of the present invention is to provide an electrophotography imaging apparatus that applies the above-mentioned developer supply container.

TECHNICAL SOLUTIONS

In order to achieve the first and the second objects of the present invention, the developer supply container provided by the present invention is comprising an accommodating cylinder and feeding components are provided in the accommodating cylinder, a drive receiving portion is provided at the outer surface of the accommodating cylinder, a housing is further provided at one end of the accommodating cylinder of the developer supply container, a powder outlet is provided in the housing, wherein a first storage portion is provided at the end of the feeding component close to the housing, a second storage portion is provided in the housing and is in communication with the first storage portion, and the second storage portion is in communication with to the powder outlet, a stirring device is provided in the second storage portion.

A preferred embodiment is that the stirring device comprising a shaft rotating component, and a elastic blade is fixed on the shaft rotating component.

Further, the number of the elastic blades is more than two, a plurality of the elastic blades is provided circumferentially around the shaft rotating component.

Further, the elastic blade has a fixed end and a free end, the fixed end is fixed on the shaft rotating component and the free end is abutted on the circumferential wall of the second storage portion.

Further, the developer supply container comprising a transmission component, the transmission component receives the turning force output by the feeding component and drives the shaft rotating component to rotate.

Further, the transmission component comprising a driving gear, the rotating shaft of the driving gear is connected with the feeding component, the driving gear drives the driven gear to rotate, the rotating shaft is fixedly connected to the driven gear.

Further, a shaft hole is provided at one end of the feeding component close to the driving gear, the rotating shaft of the driving gear is inserted into the shaft hole.

Further, a transmission port is provided between the first storage portion and the second storage portion, with the axis of the housing as the center, the central angle corresponding to the transmission port is smaller than the central angle corresponding to the first storage portion.

Further, on the projection of the plane of the powder outlet, at least part of the transmission port is not overlapped with the powder outlet.

Further, free ends of the elastic blade can extend into the transmission port and free ends of the elastic blade pass through the powder outlet.

Further, a feeding portion is provided at the end of the feeding component close to the housing, the two end faces of the first storage portion are the two end faces of the feeding portion in the circumferential direction of the feeding component. an extension plate is provide in the housing, with the axis of the feeding component as the center, the extension plate is located on the radially outer side of the feeding portion; the transmission port is provided between the free end of the extension plate and the circumferential wall of the housing.

Further, the number of the feeding portion is more than two, the two end faces of the first storage portion are the two end faces of the adjacent feeding portions.

Another developer supply container provided by the present invention comprising an accommodating cylinder and a feeding component arranged in the accommodating cylinder, wherein an outer surface of the accommodating cylinder is provided with a driving receiving portion; a housing located at one end of the accommodating cylinder, the housing is provided with a powder outlet, a gate is detachable provided on the housing, and the gate can open or close the powder outlet; wherein, a developer storage portion is provided in the housing, and the developer storage portion is in communication with the powder outlet, a stirring device is provided in the developer storage portion, the stirring device comprising a shaft rotating component and an elastic blade, a fixed end of the elastic blade is fixed on the shaft rotating component, a free end of the elastic blade can pass through the powder outlet and abut the gate.

Further, at least one boss is provided on the circumferential wall of the developer storage portion, the boss is extending from the circumferential wall of the developer storage portion to the axis direction of the developer storage portion, in the rotation direction of the elastic blade, the boss is located at the upstream end of the powder outlet.

Further, at least two feeding portions are provided on the feeding component at the end close to the housing, a first storage portion is provided between the two adjacent feeding portions; the housing comprising an extension plate therein, a transmission port is formed between the free end of the extension plate and the circumferential wall of the housing, the free ends of the elastic blade can abut on the extension plate.

Further, in the rotation direction of the elastic blade, the extension plate is located at the upstream end of the transmission port, and the free end of the elastic blade can pass through the transmission port. Further, on the projection of the plane where the powder outlet is located, the projection of the powder outlet and the projection of the transmission port are non-overlapped.

Further, a powder feeding outlet is provided on the gate, the powder feeding outlet is provided directly opposite the powder outlet when the gate is in the open position, preferable, the area of the powder feeding outlet is smaller than the area of the powder outlet.

Further, along the axial direction of the shaft rotating component, the length of the elastic blade is shorter than the length of the powder outlet. In this way, can make sure the free end of the elastic blade can pass through the powder outlet and abut to the gate thus exerting force on the developer which is on the gate.

Further, the amount of developer passing through the powder feeding port is between 18 grams and 22 grams every time the stirring device rotates per minute.

Further, the developer supply container further comprising a transmission component, the transmission component receives the turning force output by the feeding component and drives the shaft rotating component to rotate.

Further, the transmission component comprising a driving gear, the rotating shaft of the driving gear is connected with the feeding component, the driving gear drives the driven gear to rotate, the rotating shaft is fixed connected with the driven gear.

Further, a shaft hole is provided at one end of the feeding component close to the driving gear, the rotating shaft of the driving gear is inserted into the shaft hole.

Further, the rotation direction of the stirring device and the rotation direction of the feeding component are the same, and the rotation speed ratio of the stirring device and the feeding component is between 4:1 and 5:1.

Further, the feeding component is provided a plate body and guide ribs are formed on each of the two sides of the plate body, each of the guide ribs is extending from the surface of the plate body to both sides.

To achieve the third object of the present invention, the electrophotography imaging apparatus provided by the present invention comprising image processing units and the above-mentioned developer supply container, and a developer supply container is detachably provided in the image processing unit.

BENEFICIAL EFFECT

The present invention stirs the developer from entering the second storage portion by the stirring device located in the second storage portion, which can ensure the developer entering the second portion maintain a fluffy state. Moreover, since the second storage portion is in communication with the powder outlet is more beneficial to transfer the developer maintained in a fluffy state to the powder outlet, which can ensure the developer pass through the powder outlet smoothly. In addition, since the developer entering the second storage portion from the first storage portion of the feeding component and after the developer entering the second storage portion developer will be stirred by stirring device, which can ensure the developer entering the second storage portion remain in a fluffy state.

In addition, since after developer entering the second storage portion are stirred by the stirring device, it makes the developer flow more quickly to the powder outlet, speeding up the flow of the developer, and the developer in the first storage portion can also flow more quickly to the second storage portion, making more developer flow out from the powder In the present invention, the shaft rotating component drives elastic blade to rotate can stir developer which entering the second storage portion from the first storage portion so as to ensures the developer can maintain a fluffy state in the second storage portion.

By arranging multiple elastic blades, it can ensure the developer in the second storage portion can be fully stirred and effectively prevent the developer from forming a mass at the upstream end of the powder outlet.

In addition, free ends of the elastic blade are abutted on the circumferential wall of the second storage portion can fully stir the developer which sliding onto the circumferential wall of the second storage portion to prevent the developer from accumulating on the circumferential wall of the second storage portion. Moreover, when elastic blade slide from the circumferential wall of the second storage portion to the transmission outlet, the elastic restoring force formed by free ends of elastic blades will further push the developer flow to the powder outlet, thus making the amount of the developer flow to the powder outlet is higher each time and improving the transfer volume of the developer.

The present invention drives the shaft rotating component of the stirring device to rotate by transmission component, which can ensure the synchronous rotation of the stirring device and the feeding component, that is, when the developer supply container rotates, the stirring device also rotates synchronously, so as to ensure that developer is stirred by the stirring device once entering the second storage portion and ensure developer maintain a fluffy state in the second storage portion.

The rotating shaft of the driving gear is connected with the feeding component and drives the driven gear to rotate, which can effectively ensure the synchronization of the rotation of the stirring device and the feeding component.

In addition, the feeding component and the driving gear cooperate with each other through the shaft hole to achieve transmission, which can improve the reliability and synchronization of transmission.

In addition, the length of the outer circumferential wall of the first storage portion in the circumferential direction is longer than the transmission outlet in the circumferential direction, the developer located on the first storage portion does not enter the second storage portion through the transmission outlet quickly, but takes a certain amount of time to pass through the transmission outlet, which is conducive to the stirring device to fully stir the developer that slowly enters the second storage portion, so that developer is in a fluffy state for a long time.

Moreover, the developer needs to pass through a more curved path which enters the second storage portion from the first storage portion through the transmission outlet and then stirred by the stirring device to enter the powder outlet, so that it can more effectively prevent the rapid flow of the developer to the powder outlet and prevent the phenomenon of the developer forming a mass.

In this way, free ends of elastic blade can fully stir the developer at the transmission outlet, and also can exert a thrust on the developer to make the developer flow to the powder outlet, increasing the amount of the developer provided to the powder outlet each time. In addition, free ends of elastic blade can exert a circumferential rotation force on the developer on the gate below the powder outlet, thus driving the developer falling onto the gate to rotate and preventing the developer from accumulating on the gate to ensure the amount of the developer passing through the powder feeding outlet on the gate each time.

The first storage portion is formed by the feeding portion and the circumferential wall of the housing, which makes the structure of the developer supply container is simple, and the developer can guide the flow by the extension plate, which can ensure the developer rotate in a predetermined direction, further can adjust the amount of the developer entering the second storage portion each time.

The present invention provides a plurality of feeding portions that can make the developer uniform flow to the second storage portion when the developer supply container rotates once which can improve the uniformity of developer supplement.

After the developer entering the second storage portion, it is stirred by the stirring device in the same direction as the feeding component rotates, so that the developer is conducive fully stirred and maintains a fluffy state. In addition, since the developer have certain inertias when they are transferred to the first storage portion by the feeding component, after entering the second storage portion, they are stirred by the stirring device in the same rotation direction, which helps to improve the amount of the transfer volume of the developer.

In addition, since after developer entering the second storage portion are stirred by the stirring device, it makes developer flow more quickly to the powder outlet, speeding up the flow of developer, and developer in the first storage portion can also flow more quickly to the second storage portion, making more developer flow out from the powder outlet with each rotation of the developer supply container and improving the transfer volume of the developer.

In addition, the elastic potential energy is formed in the present invention by being abutted by the boss through the elastic blade, the developer will be exerted a greater force when the free end of the elastic blade entering the powder outlet, which is helpful to push more developer to the powder feeding outlet and ensure the transfer volume of the developer.

When the elastic potential energy is accumulated by the elastic blade, the free end of the elastic blade can push more developer into the developer storage portion when the free end passes through the transmission port, which can improve the transfer volume of the developer.

The present invention can make sure the developer in the developer storage portion can pass through the powder feeding outlet effectively and be transferred to outside of the developer supply container due to the area of the powder feeding outlet is smaller than the area of the powder outlet.

In addition, the present invention can make sure the free end of the elastic blade can pass through the powder outlet and abut to the gate, and exert force to the developer located on the gate as well as make sure the transfer volume per minute of the developer supply container.

The present invention is further described hereinafter in conjunction with the accompanying drawings and embodiments.

DETAILED DESCRIPTION OF THE INVENTION

A developer supply container in the present invention can be arranged in an image processing unit of an electrophotography imaging apparatus, preferably, the developer supply container is detachably arranged in the image processing unit. The developer supply container contains developer such as toner, which can flow out from the developer supply container and develops the electrostatic latent image formed on the image processing unit to form a visible image on media such as paper.

Figure 1:
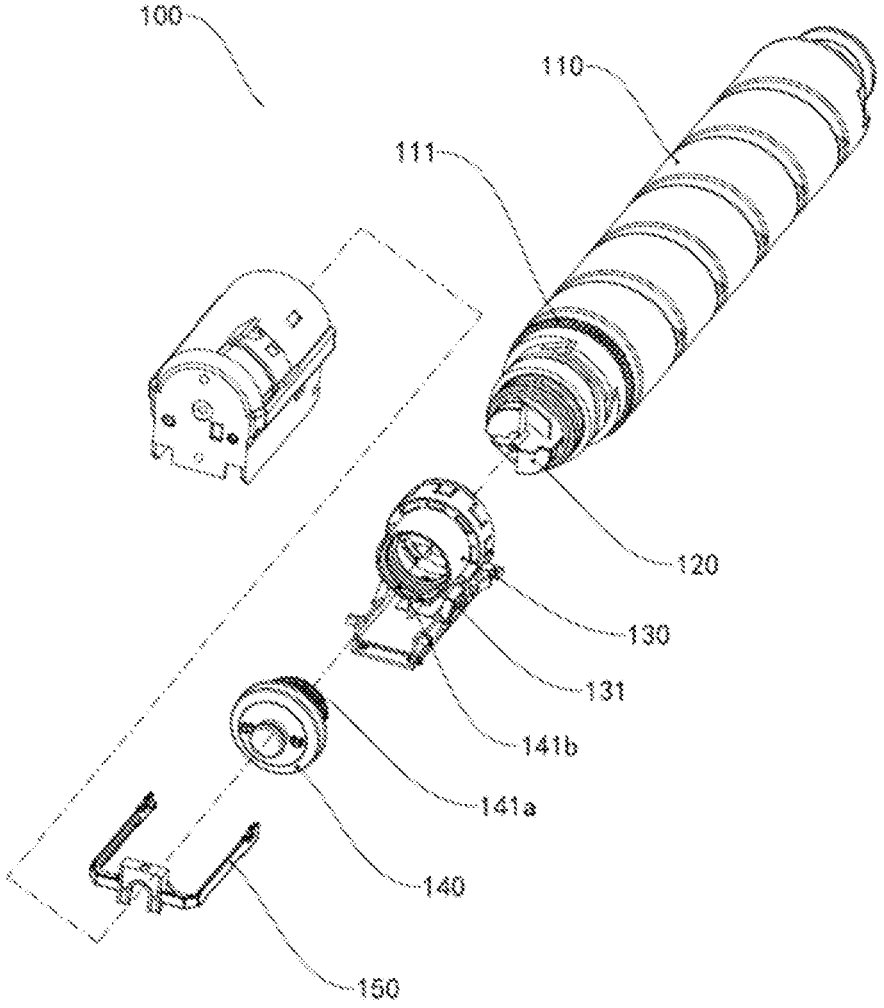
FIG. 1 is an exploded view of the structure of the existing developer supply container.
Figure 2:
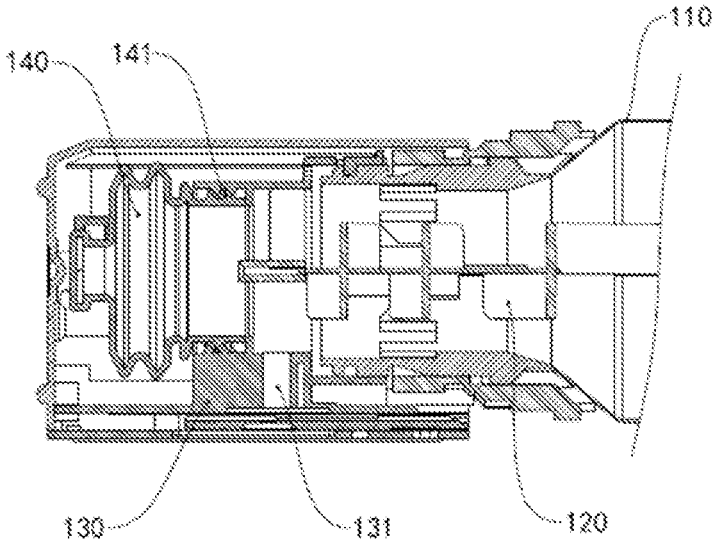
FIG. 2 is a partially sectional view of the existing developer supply container.
Figure 3:
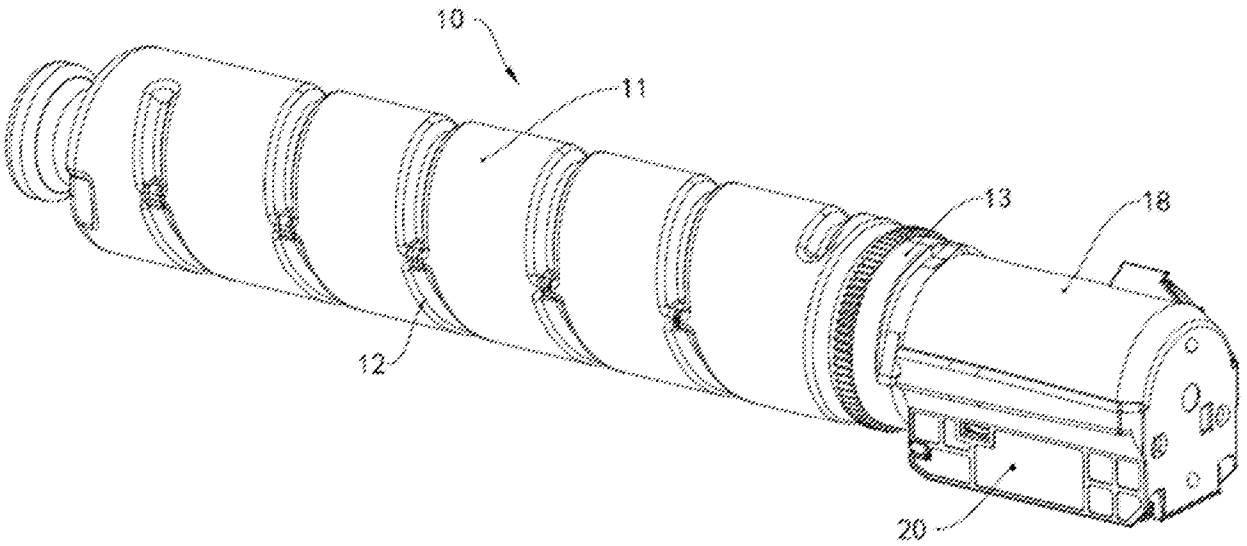
FIG. 3 is a structural view of an embodiment of the developer supply container of the present invention.

Referring to FIG. 3, the developer supply container of the present embodiment comprising a roughly cylindrical accommodating cylinder 10, the accommodating cylinder 10 comprising a cylinder 11, and spiral-shaped guide grooves 12 are formed on the circumferential wall of the cylinder 11, guide grooves 12 are recessed from the outer surface of the circumferential wall of the cylinder 11 toward the axis of the cylinder 11. At one end of the accommodating cylinder 10 provided a housing 20 and an external cover 18, the external cover 18 is covered on the housing 20. In the accommodating cylinder 10 is loaded with the developer such as toner, as seen in FIG. 3, guide grooves 11 is spirally inclined from the end away from the housing 20 to the end close to the housing 20, in this way, when the accommodating cylinder 10 rotates, the developer in the accommodating cylinder 10 pushed by the guide grooves 11 continuously moved to the side of the housing 20, so as to be transferred out of the accommodating cylinder 10.

Figure 4:
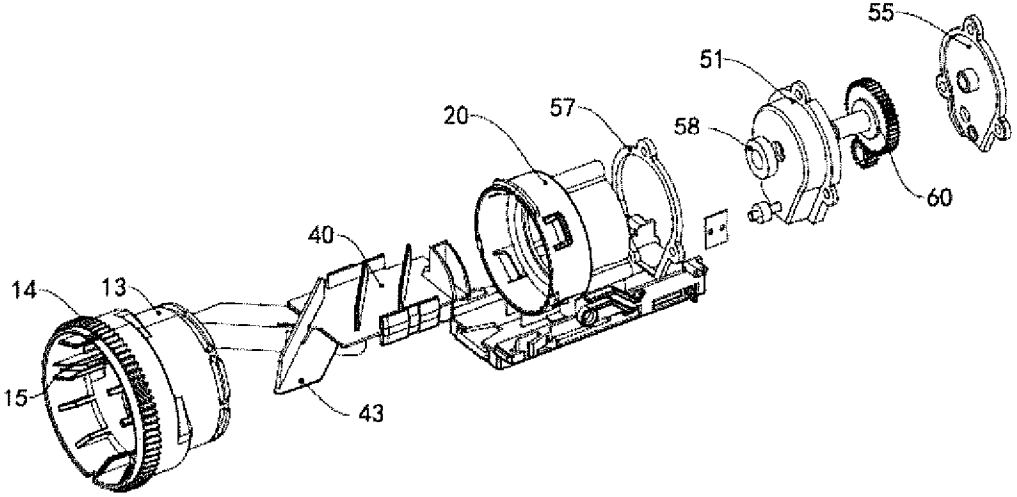
FIG. 4 is an exploded view of the structure of the concealed accommodating cylinder of an embodiment of the developer supply container of the present invention.

In the embodiment, the cylinder 11 is closed at the end away from the housing 20, but an outlet is arranged at the end which closes to the housing 20, further, a sleeve 13 is provided at the end of the cylinder 11 close to housing 10, and preferably, the sleeve 13 is fitted at the circumferentially outer side of the open end of the cylinder 11. Referring to FIG. 4, a ring of gear teeth 14 which as a drive receiving portion of the embodiment is arranged on the outer surface of the sleeve 13, and gear teeth 14 can receive the drive force output by the drive component of the electrophotography imaging apparatus, for example, the drive component is a gear, which engages gear teeth 14, when the gear rotates, it drives gear teeth 14 to rotate, so as to drives the sleeve 13 to rotate.

Further, two clamping blocks 15 are provided on the inner surface of the sleeve 13, and stress plates are provided on the outer surface of the circumferential wall of the open end of the cylinder 11, stress plates are inserted into clamping blocks 15, when the sleeve 13 rotates, the cylinder 11 will rotate synchronously with the sleeve 13.

A feeding component 40 is provided in the accommodating cylinder 10, specifically, the feeding component 40 is a stirring frame, and two fixed pieces 43 are provided at one end of the feeding component 40, the inner surface of the cylinder 11 is provided two clamping blocks, and fixed pieces 43 are clamped in the clamping blocks on the inner wall of the cylinder 11. When the cylinder 11 rotates, the feeding component 40 will rotate synchronously with the cylinder 11. Thus, the sleeve 13, the cylinder 11, and the feeding component 40 will rotate synchronously, i.e., the rotation speed and the rotation direction are the same.

Figure 5:
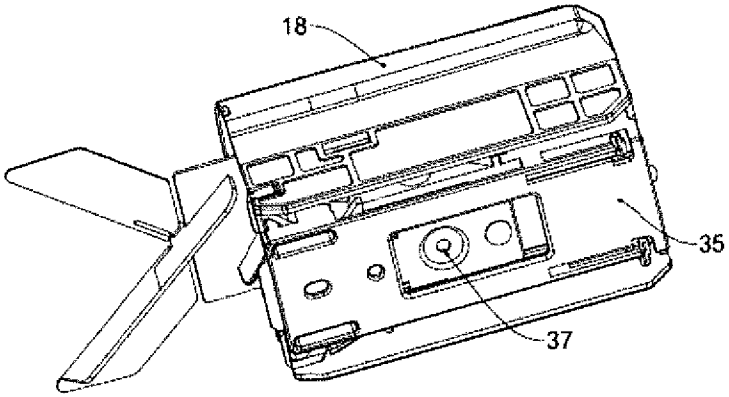
FIG. 5 is an enlarged view of the structure of the concealed accommodating cylinder of an embodiment of the present invention.
Figure 6:
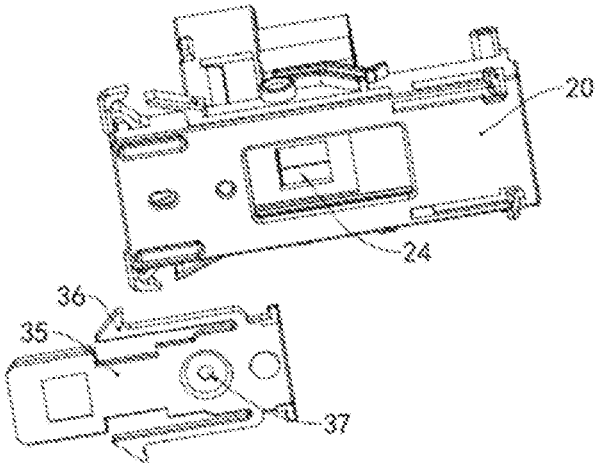
FIG. 6 is an exploded view of the structure of the housing and gate of an embodiment of the present invention.

The housing 20 is provided at one end of the accommodating cylinder 10, but the housing 20 does not follow the rotation of the accommodating cylinder 10. The external cover 18 is fastened to one side of the housing 20. Referring to FIG. 5 and FIG. 6, on one sidewall of the housing 20 is provided a powder outlet 24, the developer in the accommodating cylinder 10 is transferred to the housing 20 after passing through the feeding component 40 and can be transferred out of the powder outlet 24. In order to prevent the developer from flowing out from the outlet 24 before the developer supply container has arranged to the electrophotography imaging apparatus, on one of the sidewalls of the housing 20 is provided a gate 35, a powder feeding outlet 37 is provided on the gate 35, as seen in FIG. 6, the powder outlet 24 is square and the powder feeding outlet 37 is a circle, and the area of the powder feeding outlet 37 is smaller than the area of the powder outlet 24.

The gate 35 can move relative to the housing 20, thus, fasteners 36 are provided on the two sides of the gate 35, on the two sides of the housing 20 is provided spouts, fasteners 36 can slide in the spouts. Before the developer supply container has arranged into the electrophotography imaging device, the powder feeding outlet 37 does not overlap with the powder outlet 24, i.e., the powder feeding outlet 37 does not directly face the powder outlet 24, so that developer can be prevented from flow out. After the developer supply container has arranged into the electrophotography imaging apparatus, one of the drive components of the electrophotography imaging apparatus will drive the gate 35 to move and make the powder feeding outlet 36 directly face the powder outlet 24, as seen in FIG. 5. After the accommodating cylinder 10 rotating, the developer can pass through the powder outlet 24 and powder feeding outlet 37 to enter in other components of the electrophotography imaging apparatus, and form a visible image on media such as paper after development.

As the developer is transferred to the housing 20 by the feeding component 40, the developer is easy to accumulate at the powder outlet 24, which may lead to a poor supply of the developer. Thus, a stirring device is provided inside the housing in the embodiment, the developer entering the housing 20 is stirred sufficiently by the sufficient device so that developer can pass through the powder outlet 24 and the powder feeding outlet 37 smoothly.

Figure 7:
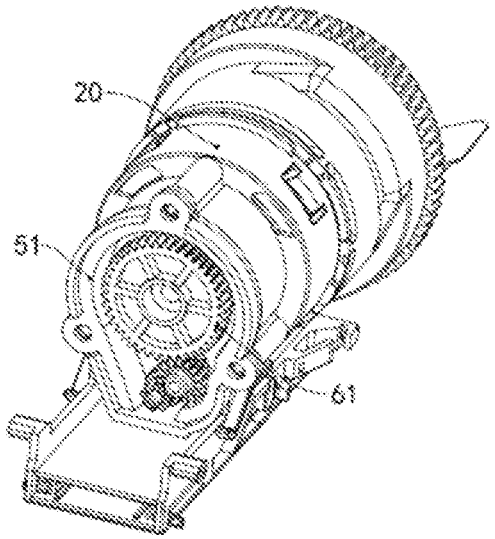
FIG. 7 is an enlarged view of the structure of the concealed accommodating cylinder, the external cover and the gear cover of an embodiment of the present invention.
Figure 8:
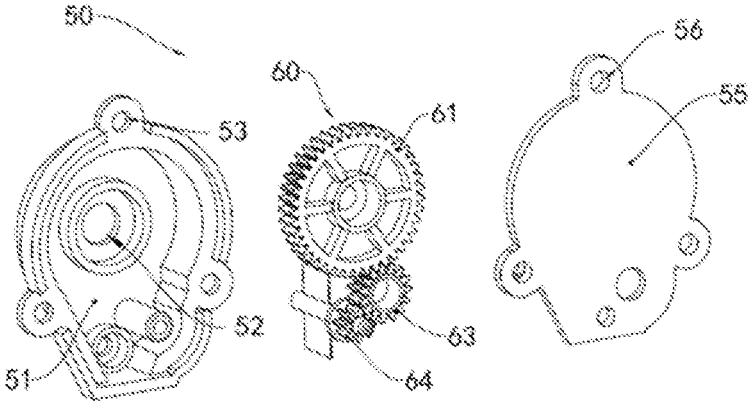
FIG. 8 is an exploded view of the structure of the transmission component and stirring device of an embodiment of the present invention.

Referring to FIG. 4, FIG. 7 and FIG. 8, a stirring component is provided in the housing 20, the stirring component comprising housing component 50 and a transmission component 60 arranged in the housing component 50, the stirring component further comprising a stirring device 64 arranged in the housing 20. The housing component 50 comprising a gear holder 51, one end of the gear holders 51 is open, and at the open end of the gear holder 51 is provide a gear cover 55, of course, a seal is provided between the gear cover 55 and the gear older 51, i.e., a ring of the sponge is provided as the seal along the outer contour of the gear cover 55.

Figure 9:
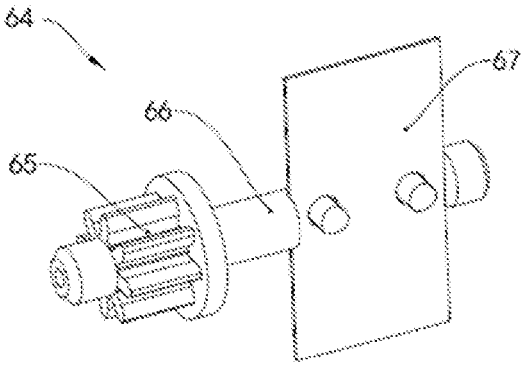
FIG. 9 is an enlarged view of the structure of the stirring device of an embodiment of the present invention.

The transmission component 60 comprising a driving gear 61 and a driven gear 63, and as shown in FIG. 9, the stirring device 64 comprising a driven gear 65, a rotating shaft 66 and an elastic blade 67, the driving gear 61 engages with the driven gear 63 and drives the driven gear 63 rotate, and the driven gear 63 engages with the driven gear 65 and drives the driven gear 65 rotate. And the driving gear 65 is fixed communication with the rotating shaft 66, the elastic blade 67 is fixed on the rotating shaft 66. Thus, when the driving gear 61 rotates, it will drive the driven gear 63 and the driven gear 65 rotates in turn, thereby driving the elastic blade 67 to rotate around the axis of the rotating shaft 66.

In the embodiment, the elastic blade 67 of the stirring device 64 is fixed on the rotating shaft 66, in actual application, if the stirring device is set into a frame structure, for example, the stirring device has a ring-shaped frame, and a rod is set inside the frame as a shaft rotating component, the elastic blade is fixed on the shaft rotating component, when the frame rotates it drives the shaft rotating component to rotate, thereby drives the elastic blade to rotate. It is understood that the rotating shaft 66 in the embodiment is a special rotating shaft component.

Figure 10:
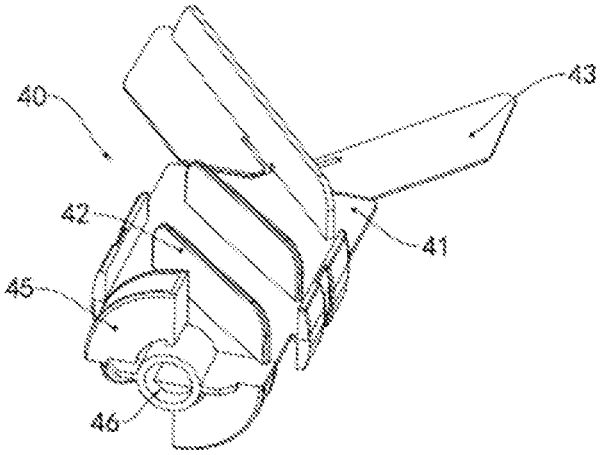
FIG. 10 is an enlarged view of the structure of the feeding component of an embodiment of the present invention.
Figure 11:
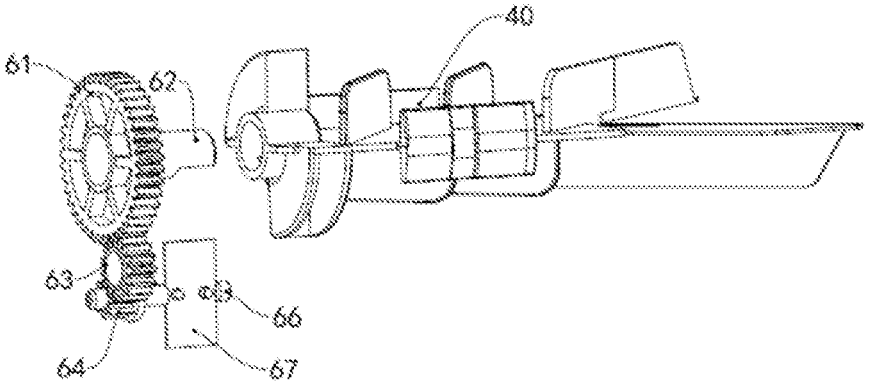
FIG. 11 is an exploded view of the structure of the feeding component, the transmission component and the stirring device in the first view of an embodiment of the developer supply container of the present invention.
Figure 12:
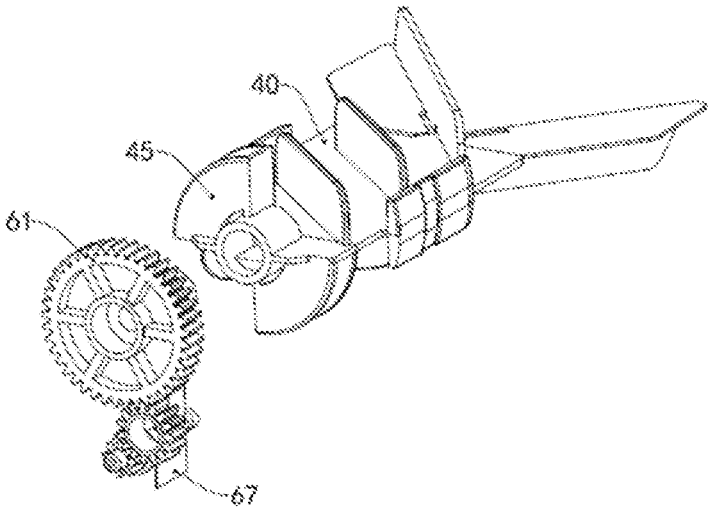
FIG. 12 is an exploded view of the structure of the feeding component, the transmission component and the stirring device in the second view of an embodiment of the developer supply container of the present invention.

In the embodiment, the drive gear 60 is driven to rotate by the feeding component 40. Referring to FIG. 10 to 12, the feeding component 40 is provided a plate body 41 and a plurality of guide ribs 42 formed on each of the two sides of the plate body 41, each of the guide ribs 42 extends from the surface of the plate body 41 to both sides. Moreover, the extension direction of guide ribs 42 is inclined to the axial direction of the accommodating cylinder 10, when the accommodating cylinder 10 rotates, the developer moves toward the direction to the housing 20 under the guidance of the guide ribs 42, thereby transferring the developer from the cylinder 11 to the side of the housing 20. As seen in FIG. 10, fixed blades 43 are provided at one end of the plate body 41, and preferably, fixed blades 43 are located at the end of the plate body 41 close to the cylinder 11.

At the end of the plate body 41 which is away from fixed blades 43 is provided a shaft hole 46, inside the shaft hole 46 is provided a spline. Further, the gear holder 51 is mounted to one end of the housing 20. And the bottom wall of the gear holder 51 is provided a shaft hole 52, the rotating shaft 62 of the driving gear 61 passes through the shaft hole 52 and inserted into the shaft hole 46. As seen in FIG. 11, the rotating shaft 52 is a non-circular shaft, in this way, after the rotating shaft 62 inserting into the shaft hole 46, when the feeding component 40 rotates, it will drive the driving gear 61 to rotate and thus drive the stirring device 64 to rotate.

In the embodiment, the rotation direction of the driving gear 61 is the same as the rotation direction of the feeding component 40, but the rotation direction of the driven gear 65 is opposite to the rotation direction of the feeding component 40, in this way, the rotation direction of the driven gear 65 is the same as the rotation direction of feeding component 40, i.e., the rotation direction of the elastic blade 67 is the same as the rotation direction of the feeding component 40. Preferably, the rotation speed ratio of the stirring device 64 and the feeding component 40 is between 4:1 and 5:1, i.e., for each rotation of the feeding component 40, the stirring device 64 rotates 4 to 5 rotations, furthermore, the rotation speed ratio of the stirring device 64 and the feeding component is 4.5:1, i.e., for each rotation of the feeding component 40, the stirring device rotates 4.5 rotations.

In the embodiment, the elastic blade 67 is one piece, and the middle of the lengthwise direction of the elastic blade 67 is fixed on the shaft rotating 66, i.e., the middle of the elastic blade 67 is a fixed end, and the two ends of the lengthwise direction are free ends. The elastic blade 67 can be elastically deformed when it rotates, and enlarged the stirring force that applied to the developer, which makes the developer is fully stirred.

In addition, at the end of the feeding component 40 which is away from the fixed piece 43 is provided two feeding portions 45, both of these feeding portions 45 are quarter circles, and both of these feeding portions 45 are provided on the outer circumferential wall of the shaft hole 46.

Figure 13:
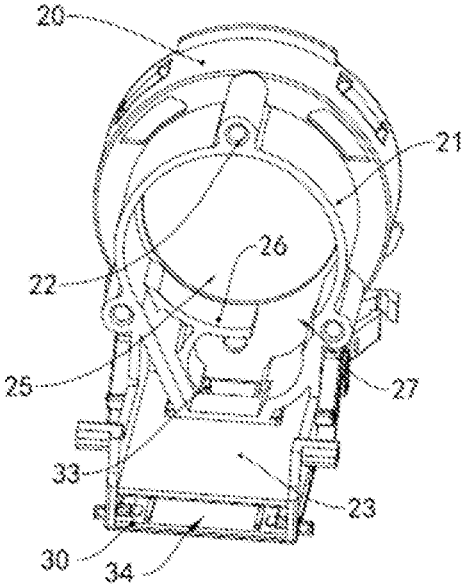
FIG. 13 is a structural view of the housing in the first view of an embodiment of the developer supply container of the present invention.
Figure 14:
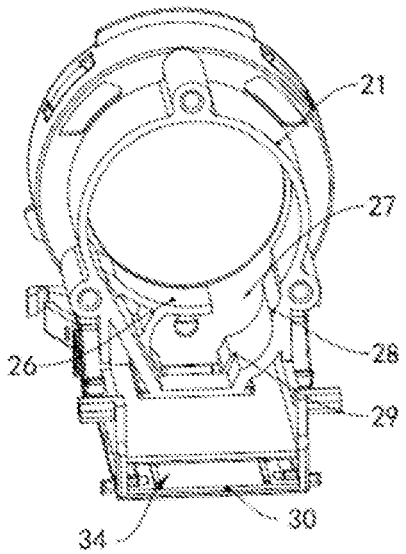
FIG. 14 is a structural view of the housing in the second view of an embodiment of the developer supply container of the present invention.

Referring to FIG. 13 and FIG. 14, the housing is provided a circular circumferential wall 21, and one end of the housing 20 is provided a bottom plate 30, on the side of the bottom plate 30 which is close to the circumferential wall 21 is provided a support plate 23, the support plate 23 and the bottom plate 30 are parallel to each other, and a gap 34 is formed between the support plate 23 and the bottom plate 30, the gate 35 is mounted in the gap 34 and can move reciprocally in the gap 34, so as to make the gate 35 open or close the powder outlet 24.

The circumferential wall 21 of the housing 20 has enclosed an accommodating cavity 25, both ends of accommodating cavity 25 are opened along the axial direction of the cylinder 10, the gear holder 51 is arranged in one open end of the accommodating cavity 25. One end of the feeding component 40 can be arranged in the accommodating cavity 25, thus, the developer will be transferred into the accommodating cavity 25. In order to prevent leakage of the developer inside the accommodating cavity 25 from the gap between the housing 20 and the gear holder 51, as seen in FIG. 4, a seal 57 is provided between the housing 20 and the gear holder 51, the outer contour of the seal 57 and the gear holder 51 are the same. Preferably, the seal 57 is made of sponge material. In addition, since the rotating shaft 61 of the driving gear 60 needs to be inserted into the shaft hole 46 of the feeding component 40, in order to prevent the leakage of the developer, on the outside of the rotating shaft 61 is provided a sealing ring 58, the sealing ring 58 is abutted the axial outside of the shaft hole 46. Preferably, the sealing ring 58 is also made of sponge material.

On the radially outer side of the circumferential wall 21 of the housing 20 is provided three threaded holes 22, as shown in FIG. 8, three through holes 53 is provided on the outer wall of the gear holder 51 accordingly, on the gear cover 55 is provided three through holes 56, using screws to pass through the through holes 53 of the gear holder and the through holes 56 of the gear cover 55, screws are screwed into the threaded holes 22 to realize the fixation of the gear cover 55, the gear holder 51 with the housing 20.

The powder outlet 24 is provided on the support plate 23, on the side of the accommodating cavity 25 close to the powder outlet 24 is provided an extension plate 26, the extension plate 26 is bending extended from the inner surface of the circumferential wall 21 toward the side of the powder outlet 24, further, only one end of the extension plate 26 is connected to circumferential wall 21, and the other end of the extension plate 26 is not connected with circumferential wall 21 and thereby is formed a transmission port 27, as seen in FIG. 13 and FIG. 14, the transmission port 27 is a gap formed between the extension plate 26 and the circumferential wall 21. In the embodiment, the accommodating cavity 25 is a cavity with two sides of open ends surrounded by the circumferential wall 21, the extension plate 26, and the transmission port 27. Moreover, with the axis of the feeding component 40 as the center, the extension plate 26 is located radially outside of the feeding portion 45, i.e., the diameter of the extension plate 26 is larger than the diameter of the outer edge of the feeding portion 45. In this way, it can prevent the extension plate 26 from obstructing the rotation of the feeding component 40.

Figure 15:
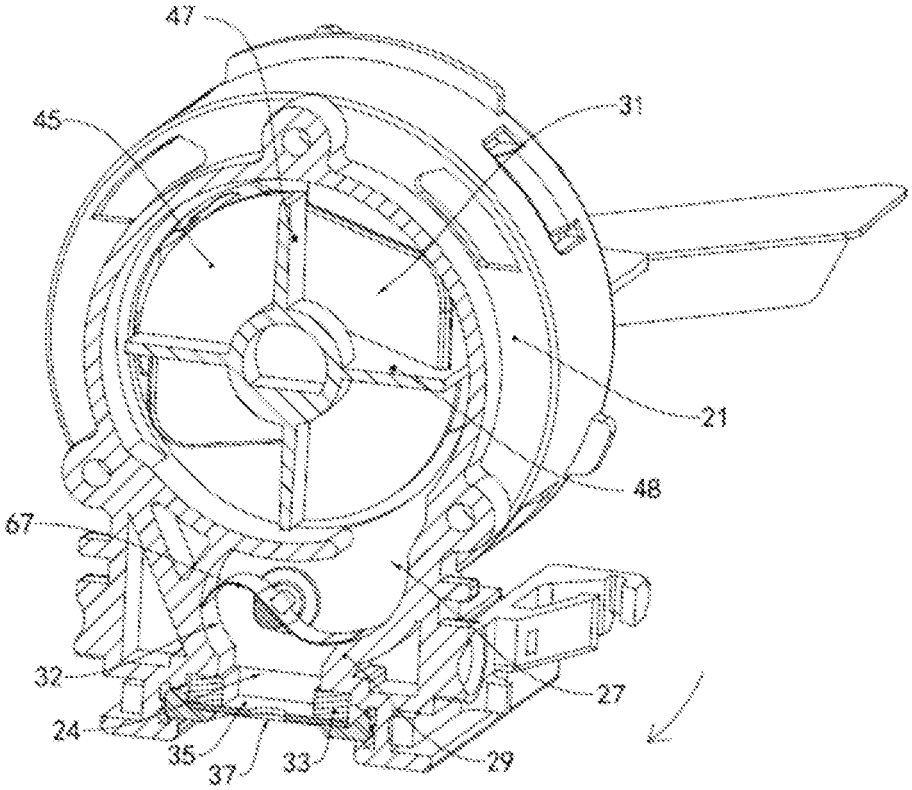
FIG. 15 is a partial sectional view of the embodiment of the developer supply container of the present invention in the first state.

On the side of the extension plate 26 close to the powder outlet 24 is provided a developer storage portion 32, entering into the accommodating cavity 25, the developer can pass through the transmission port 27 and are transferred to the developer storage portion 32 and then transferred to the powder outlet 24. Referring to FIG. 15, one of the ends of the feeding component 40 is located in the accommodating cavity 25, specifically, both of feeding portions 45 are located in the accommodating cavity 25, and there is a gap between the radial outer contour of feeding portions 45 and the circumferential wall 21 of the housing 20 so that the feeding portions 45 can rotate in the accommodating cavity 25.

When the accommodating cylinder 10 rotating, the developer is driven by the feeding component 40 and are transferred to the end close to the feeding portion 45 along the guide rib 42, at this time, the developer entering into the accommodating cavity 25, as seen in FIG. 15, the first storage portion 31 is enclosed between the two adjacent feeding portions 45 and the circumferential wall 21 of the housing 20, after the developer entering the accommodating cavity 25 are actually transferred to the first storage portion 31. As the feeding component 40 is provided two feeding portions 45 so the accommodating cavity 25 is formed two first storage portions 31. With the axis of the shaft hole 46 as the centerline, each of two sidewalls of the first storage portion 31 in the circumferential direction is two endwalls of two feeding portions 45. Referring to the upper left corner of FIG. 15, one of the sidewalls of the first storage portion 31 is the endwall of the feeding portion 47 and the other is the endwall of another feeding portion 48. With the rotation of the feeding component 40, the first storage portions 31 are rotating along the axis of the accommodating cylinder 10.

After the developer supply container is arranged into the electrophotography imaging apparatus, the first storage portions 31 are located in the connected top of the transmission port 27, i.e., as the state is shown in FIG. 15, as the first storage portions 31 are connected to the transmission port 27, and the transmission port 27 is located below the first storage portions 31, thus, after the developer is transferred to the first storage portions 31, it will pass through the transmission port 27 and enter the developer storage portion 32 by gravity. In the embodiment, the developer storage portion 32 is the second storage portion.

In addition, the powder outlet 24 of the housing 20 is located below the developer storage portion 32, so the developer can pass through the powder outlet 24 from the developer storage portion 32 by gravity, then pass through the powder feeding outlet 37 to discharge from the developer supply container, and be transferred to other components of the electrophotography imaging apparatus.

As the developer is easy to accumulate in the developer storage portion 32, leading the developer formed a mass and is not easy to be transferred to the powder outlet 24, thus, the stirring device 64 is provided in the developer storage portion 24 and rotates with the feeding component 40, thereby stirring the developer in the developer storage portion 32 to prevent the developer from accumulating.

In the embodiment, the rotation direction of the stirring device 64 is the same as the rotation direction of the feeding component 40, i.e., rotating along with the direction of the arrow in FIG. 15, after the developer passing through the transmission port 27 from the first storage portions 31 to enter the developer storage portion 32, the stirring device 64 is fully stirring the developer. As seen in FIG. 15, take a point on the axis of the housing 20 as the center of the circle, the central angle corresponding to the transmission port 27 is smaller than the central angle corresponding to the first storage portions 31, i.e., in the circumferential direction on the circumferential wall 21 of the housing 20, the length of the transmission port 27 is shorter than lengths of the first storage portions 31. This kind of design makes the length of the transmission port 27 smaller, and prevent the developer in the first storage portions 31 from passing through the transmission outlet 27 quickly, but making the developer pass through the transmission port 27 successively during the rotation of the first storage portions 31 and prevent a large amount of developer from entering the developer storage portion 32 in a short period of time and making a large amount of developer accumulate in the developer storage portion 32.

In addition, on the projection of the plane in which the powder outlet 24 is located, the projection of the transmission port 27 and the projection of the powder outlet 24 are non-overlapped, in this way the developer needs to go through a curved path to pass through the powder outlet 24 after entering the developer storage portion 32 from the transmission port 27 to prevent the developer from entering the powder outlet 24 quickly, and facilitate the stirring device 64 to fully stir the developer. In other embodiments, on the projection of the plane in which the powder outlet 24 is located, the projection of the transmission port 27 and the projection of the powder outlet 24 can be partially overlapped and at least some parts of them are non-overlapped.

In the embodiment, the length of elastic blade 67 is a bit longer, and free ends of the elastic blade can abut to the circumferential wall of the developer storage portion 32. As shown in FIG. 15, a boss 29 is provided on the circumferential wall of the developer storage portion 32, the boss 29 is extending from the inner surface of the circumferential wall of the developer storage portion 32 to the axis direction of the developer storage portion, and in the rotating direction of the elastic blade 67, the boss 29 is located at the upstream end of the powder outlet 24. In this way, when the elastic blade 67 is rotating, free ends of the elastic blade 29 can abut on the circumferential wall of the developer storage portion 32, and further will occur the elastic deformation and accumulate the elastic potential energy. In other embodiments, the number of the boss 29 can also be more than two.

Figure 16:
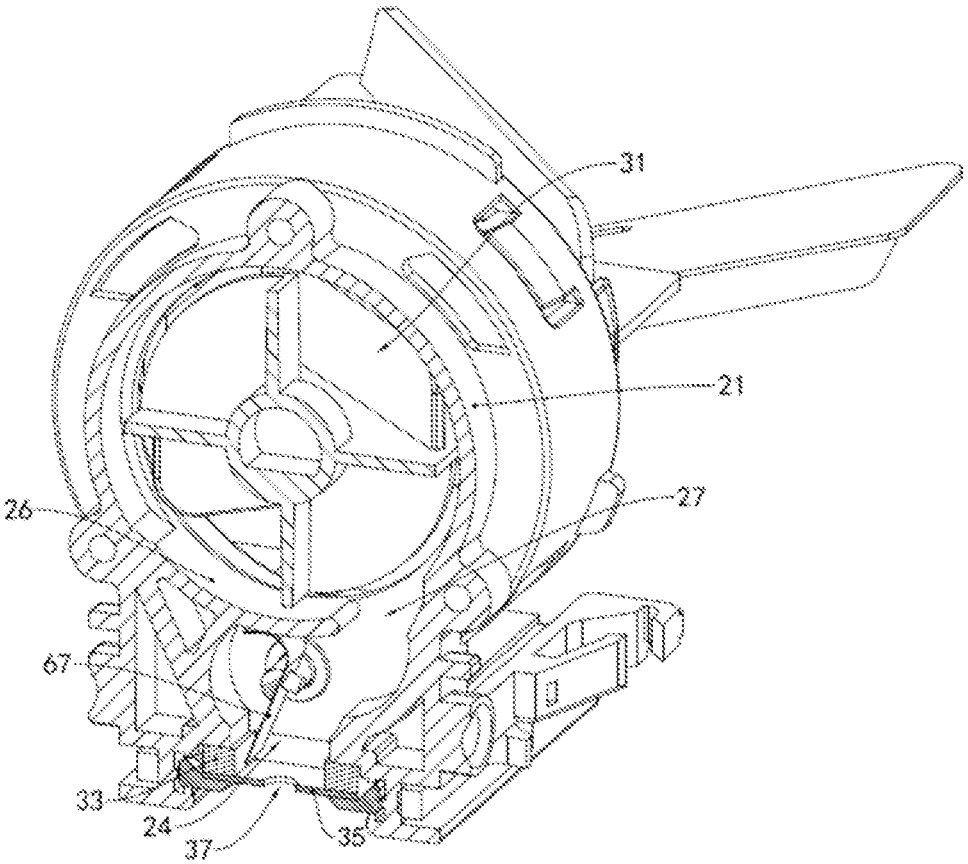
FIG. 16 is a partial sectional view of the embodiment of the developer supply container of the present invention in the second state.

When the stirring device 64 is continue to rotate, and become the state as shown in FIG. 16, free ends of the elastic blade 67 are passing through the powder outlet 24. Preferably, along the axial direction of the rotating shaft 66 of the stirring device 64, the length of the elastic blade 67 is shorter than the length of the powder outlet 24, in this way, free ends of the elastic blade 67 can extend to the powder outlet 24. As seen in FIG. 16, free ends of the elastic blade 67 can connect with the gate 35 located below the powder outlet 24, thereby can transfer developer on the gate 35 to the powder feeding outlet 37.

When the gate 35 is opened, the powder feeding outlet 37 is located directly below the powder outlet 24, i.e. the powder feeding outlet 37 is provided to face the powder outlet 24 directly, and the area of the powder feeding outlet 37 is smaller than the area of the powder outlet 25. In addition, a sealing component 33 is provided between the powder outlet 24 and the gate 35, the shape of the sealing component 33 is the same as the shape of the powder outlet 24, both are quadrate, and the area of the through hole in the middle of the sealing component 33 is larger than the area of the powder feeding outlet 37 and prevent the sealing component 33 from affecting the transfer of the developer by blocking the powder feeding outlet 37.

With the rotation of the stirring device 64, the state of the elastic blade 67 is changing from the state shown in FIG. 15 to the state shown in FIG. 16, the accumulated elastic potential energy of the elastic blade 67 can be released, and exert a greater force on the developer located on the gate 35 and cause a large amount of developer to be transferred into the powder feeding outlet 37 to make sure the amount of developer passed through the powder feeding outlet 37.

On the other hand, in the rotation direction of the elastic blade 67, the extension plate 26 is located at the upstream end of the transmission port 27 and free ends of elastic blade 67 can pass through the transmission port 27. As the state shown in FIG. 16, free ends of the elastic blade 67 are blocked by the extension plate 26 and cause the elastic deformation to occurred and elastic potential energy accumulated, when free ends of the elastic blade 67 reach the transmission port 27, the elastic potential energy of the elastic blade 67 can be released and exert a force to the developer passing through the transmission port 27 and the developer is pushed into the developer storage portion 32, thereby can make sure the amount of developer entering the developer storage portion 32. After testing, the scheme of applying the embodiment, the amount of developer passing through the powder feeding port 37 is between 18 grams and 22 grams every time the stirring device 64 rotates per minute, and preferably, for every minute of rotation of the stirring device 64, the amount of developer passing through the powder feeding port 37 is 20 grams, so that can make sure the amount of developer in the developer supply container.

Finally, it is emphasized that the present invention is not limited to the above-mentioned embodiments, for example, the number of elastic blades can be plurality and a plurality of elastic blades are evenly provided in the circumferential direction of the rotating shaft, in actual application, the number of elastic blade is one piece, and one end of the elastic blade can be fixed on the rotating shaft and the other is a free end that abuts to the circumferential wall of the developer storage portion.

In the embodiment, feeding component drives the stirring device through a plurality of gears. In actual application, the transmission component can be transmission components which comprising such as the chain or the belt, the worm gear and etc., and such variations should also comprise in the scope of protection of the claims of the present invention.

INDUSTRIAL APPLICABILITY

The electrophotography imaging apparatus of the present invention can be used for laser printing, the developer supply container is detachably installed in the electrophotography imaging apparatus, and the developer supply container contains developer such as toner, the developer can flow out from the developer supply container and develop the electrostatic latent image formed on the image processing unit to form a visible image on media such as paper. As the developer supply container passing through the stirring device located in the developer storage portion can stir the developer which entering the developer storage supply, which can maintain the developer in a fluffy state, and improve the transfer volume of the developer in the developer supply container.

What we claimed is:

1. A developer supply container comprising:

an accommodating cylinder and a feeding component arranged in the accommodating cylinder, wherein an outer surface of the accommodating cylinder is provided with a driving receiving portion;

a housing, located at one end of the accommodating cylinder, the housing is provided with a powder outlet;

the characterized in that:

a first storage portion is provided at an end of the feeding component which closed to the housing, and the housing is provided a second storage portion which is in communication with the first storage portion, the second storage portion is in communication with the powder outlet, and the second storage portion is provided with a stirring device therein.

2. The developer supply container according to claim 1, wherein, the stirring device comprising a shaft rotating component, an elastic blade is fixed on the shaft rotating component.

3. The developer supply container according to claim 2, wherein, the number of the elastic blade is more than two, a plurality of the elastic blades are arranged around the shaft rotating component circumferentially.

4. The developer supply container according to claim 2, wherein, the elastic blade has a fixed end and a free end, the fixed end is fixed on the shaft rotating component and the free end is abutted on the circumferential wall of the second storage portion.

5. The developer supply container according to claim 2, wherein, the developer supply container further comprising a transmission component, the transmission component receives the turning force output by the feeding component and drives the shaft rotating component to rotate.

6. The developer supply container according to claim 5, wherein, the transmission component comprising a driving gear, the rotating shaft of the driving gear is connected with the feeding component, the driving gear drives a driven gear to rotate, and the rotating shaft is fixedly connected to the driven gear.

7. The developer supply container according to claim 6, wherein, a shaft hole is provided at one end of the feeding component close to the driving gear, the rotating shaft of the driving gear is inserted into the shaft hole.

8. The developer supply container according to claim 2, wherein, a transmission port is provided between the first storage portion and the second storage portion, with the axis of the housing as the center, the central angle corresponding to the transmission port is smaller than the central angle corresponding to the first storage portion.

9. The developer supply container according to claim 8, wherein, on the projection of the plane where the powder outlet is located, at least part of the transmission port is not overlapped with the powder outlet.

10. The developer supply container according to claim 8, wherein, the free end of the elastic blade pass through the powder outlet.

11. The developer supply container according to claim 8, wherein, a feeding portion is provided at the end of the feeding component close to the housing, two end faces of the first storage portion are two end faces of the feeding portion in the circumferential direction of the feeding component;

the housing comprising an extension plate inside, with the axis of the feeding component as the center, the extension plate is located on the radially outer side of the feeding portion;

the transmission port is formed between the free end of the extension plate and the housing circumferential wall.

12. The developer supply container according to claim 11, wherein, the number of the feeding portion is more than two, the two end faces of the first storage portion are the two end faces of the adjacent feeding portions.

13. An electrophotography imaging apparatus, comprising an image processing unit and the developer supply container according to claim 1, wherein the developer supply container can be detachably installed into the imaging processing unit.

14. A developer supply container comprising:

an accommodating cylinder and a feeding component arranged in the accommodating cylinder, wherein an outer surface of the accommodating cylinder is provided with a driving receiving portion;

a housing, located at one end of the accommodating cylinder, the housing is provided with a powder outlet, a gate is detachable provided on the housing, and the gate can open or close the powder outlet;

wherein:

a developer storage portion is provided in the housing, and the developer storage portion is in communication with the powder outlet, a stirring device is provided in the developer storage portion, the stirring device comprising a shaft rotating component and an elastic blade, a fixed end of the elastic blade is fixed on the shaft rotating component, a free end of the elastic blade can pass through the powder outlet and abut the gate.

15. The developer supply container according to claim 14, wherein:

at least one boss is formed on the circumferential wall of the developer storage portion, the boss is extending from the circumferential wall of the developer storage portion to the axis direction of the developer storage portion;

in the rotation direction of the elastic blade, the boss is located at the upstream end of the powder outlet.

16. The developer supply container according to claim 14, wherein:

at least two feeding portions are provided on the feeding component at the end close to the housing, a first storage portion is provided between the two adjacent feeding portions;

the housing comprising an extension plate inside, a transmission port is formed between the extension plate and the circumferential wall of the housing;

the free ends of the elastic blade can abut on the extension plate.

17. The developer supply container according to claim 16, wherein:

in the rotation direction of the elastic blade, the extension plate is located at the upstream end of the transmission port, and the free end of the elastic blade can pass through the transmission port.

18. The developer supply container according to claim 14, wherein:

a powder feeding outlet is provided on the gate, the powder feeding outlet is provided directly opposite the powder outlet when the gate is in open position.

19. The developer supply container according to claim 14, wherein:

along the axial direction of the shaft rotating component, the length of the elastic blade is shorter than the length of the powder outlet.

20. The developer supply container according to claim 14, wherein:

the feeding component is provided a plate body and guide ribs are formed on each of the two sides of the plate body, each of the guide ribs is extending from the surface of the plate body to both sides.

* * * * *